US007023412B2

(12) United States Patent
Goyins

(10) Patent No.: US 7,023,412 B2
(45) Date of Patent: Apr. 4, 2006

(54) METHOD AND APPARATUS FOR AVOIDING IMAGE FLICKER IN AN OPTICAL PROJECTION DISPLAY

(75) Inventor: Gregg S. Goyins, Lincoln, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 114 days.

(21) Appl. No.: 10/377,455

(22) Filed: Feb. 28, 2003

(65) Prior Publication Data

US 2003/0132904 A1 Jul. 17, 2003

Related U.S. Application Data

(63) Continuation of application No. 09/618,946, filed on Jul. 19, 2000, now Pat. No. 6,545,672.

(51) Int. Cl.
*G09G 3/36* (2006.01)

(52) U.S. Cl. ..... 345/89; 345/600

(58) Field of Classification Search ..... 345/87–89, 345/96, 99, 147, 150, 180–181, 189, 204, 345/207, 209, 600–604, 691, 744
See application file for complete search history.

(56) References Cited

U.S. PATENT DOCUMENTS 5,495,265 A * 2/1996 Hartman et al. ..... 345/87
5,737,038 A 4/1998 Gale et al.
5,892,494 A * 4/1999 Kimura et al. ..... 345/96
5,953,002 A 9/1999 Hirai et al.
6,043,801 A 3/2000 Bassetti
6,091,398 A 7/2000 Shigeta
6,275,207 B1 * 8/2001 Nitta et al. ..... 345/89
6,285,349 B1 9/2001 Smith
6,304,254 B1 * 10/2001 Johnson et al. ..... 345/204
6,373,497 B1 4/2002 McKnight et al.
6,448,962 B1 9/2002 McKnight et al.
6,577,362 B1 * 6/2003 Moore ..... 349/114

* cited by examiner

*Primary Examiner*—Amr A. Awad
*Assistant Examiner*—Tom Sheng

(57) ABSTRACT

One embodiment of the invention is a digital filter that avoids image flicker in a projection display that has two operational modes. This digital filter avoids undesired intensity variations between successive frames by changing all the assigned pixel values by the same amount during either of the two modes. This digital filter typically only needs to correct some of the least significant bits ("LSB's") of the pixel values during either operational mode. This is because the dynamic range of the flicker is often very limited (e.g., it is often less than 5%). In fact, some embodiments combine the flicker-filtering function with the dither-control function, if the correction of a LSB causes an over correction of the flicker problem.

14 Claims, 5 Drawing Sheets

METHOD AND APPARATUS FOR AVOIDING IMAGE FLICKER IN AN OPTICAL PROJECTION DISPLAY

This application claims priority and is a continuation of U.S. patent application Ser. No. 09/618,946, filed Jul. 19, 2000 now U.S. Pat. No. 6,545,672.

BACKGROUND OF THE INVENTION

1. Field of the Invention

The present invention is directed towards method and apparatus for avoiding image flicker in an optical projection display.

2. State of the Art

Optical projection displays generate images by modulating the polarization of certain regions of the light, while leaving the polarization of other regions unchanged. Such displays typically include one or more reflective or transmissive light valves.

FIG. 1 presents a typical reflective light valve for a liquid-crystal-on-silicon ("LCOS") projection microdisplay. This light valve 100 includes a reflective spatial light modulator ("SLM") 105 and an output analyzer 110. The SLM 105 receives linearly polarized light. As shown in this FIG. 1, the SLM 105 includes a layer of liquid crystal material 140 that is positioned between two electrodes 115 and 125.

Electrode 115 is a transparent electrode that is deposited on the surface of a transparent cover 120, while the electrode 125 is a reflective electrode that is located on the surface of a semiconductor substrate 130. The transparent electrode 115 is not segmented, while the reflective electrode is segmented (i.e., pixilated) into an array of pixel electrodes 135 that define the pixels of the SLM. (A substantially reduced number of pixel electrodes are shown in FIG. 1 to simplify the drawing.)

Each pixel electrode reflects the portion of the incident polarized light that falls on the pixel electrode. Each pixel electrode can also change the polarization of the light falling on it based on the electrical signals that it receives. Specifically, the potential difference between each pixel electrode and the transparent electrode establishes an electric field across the portion of the liquid crystal material that is between the pixel and transparent electrodes. This electric field in conjunction with the structure and orientation of the SLM's liquid crystal material, determine how the pixel electrode rotates the polarization of light falling on it.

The output analyzer 110 receives the light reflected by the SLM 105. This output analyzer is a polarization-selective device.(such as a polarizing filter or polarizing beam splitter) that allows a certain polarization state of the light to pass, while discarding the remaining polarization states. Hence, the output analyzer is placed at the output of the SLM to obtain the SLM's pattern of modulation, and thereby generate an image.

In addition to using light valves, some optical projection displays also include polarization compensators. A polarization compensator is an active polarizing switch that receives electrical signals that control how the polarizing switch changes the polarization of the light.

FIG. 2 presents a partial view of a projection display 200 that includes a reflective SLM 205 and a polarization compensator 210. The polarization compensator 210 allows the display to drive the SLM 205 in two modes, an inversion mode and a non-inversion mode.

The projection display 200 operates the SLM 205 in these two modes in order to avoid the "sticking" of the SLM's pixels. Sticking is a commonly recognized problem of liquid crystal displays. Sticking occurs when a pixel is left energized for an extended period, causing impurities in the liquid crystal comprising the pixel to migrate. The migration of impurities, in turn, introduces a polarization vector in the liquid crystal at the location of the pixel. This polarization vector can then offset any electric field that is applied across the pixel, and thereby prevent the pixel from switching. Such a pixel is referred to as a "stuck" pixel.

One way of avoiding sticking is to alternate the bias across each pixel during an inversion period. During the inversion period, however, the image is inverted. Therefore, the polarization compensator 210 is used to recover a positive image during the inversion period. More particularly, the driving of the polarization compensator 210 and the SLM 205 is synchronized so that these two devices provide a positive image to the viewer during inversion and non-inversion periods.

Operating a projection display in inversion and non-inversion modes introduces flicker in the displayed image. Specifically, one or more components of projection display operate non-ideally during the inversion period, the non-inversion period, or both periods. Such non-ideal operations cause these components to operate asymmetrically during the inversion and non-inversion periods. For instance, in FIG. 2, the polarization compensator 210 might rotate the polarization of the light by +24 during an inversion period and by −21 during a non-inversion period, instead of ideally rotating the polarization by ±22.5 during these two periods.

Such non-ideal, asymmetric operations cause the projection display to output light asymmetrically during the inversion and non-inversion periods. In other words, the asymmetric operations of the display's components introduce undesired, uniform intensity variations between frames projected during the inversion periods and frames projected during the non-inversion periods.

The viewer perceives the undesired, uniform intensity variations as image flicker. The degree of image flicker also varies with the temperature and voltage of the display, because the asymmetrical behavior of the components (such as the asymmetrical behavior of the polarization compensator) is a function of the temperature and voltage.

One prior art solution for minimizing flicker is to closely match the characteristics of the SLM's and compensators to achieve symmetric light throughput during both inversion and non-inversion periods. Such a solution requires precise matching of the optical properties of the SLM's and the compensators. Hence, this solution is difficult to achieve. It is also expensive, and it is not always effective, especially as time passes.

Another solution is to closely control the temperature variance of the compensator by adding circuitry to heat the compensator. This solution, however, involves the additional cost of the temperature control systems. It also complicates the structure of the polarization compensator.

Therefore, there is a need in the art for a method and apparatus that can avoid image flicker due to the asymmetrical operation of one or more components of a projection display during inversion and non-inversion periods.

SUMMARY OF THE INVENTION

One embodiment of the invention is a digital filter that avoids image flicker in a projection display. In a projection display, a viewer perceives image flicker when there is undesired light intensity variations between successive frames. Such undesired light intensity variations can occur when the display components operate asymmetrically during two operational modes (e.g., during inversion mode and non-inversion modes) and thereby output light asymmetrically during the two operational modes.

The invention's digital filter avoids undesired intensity variations between successive frames by changing all the assigned pixel values by the same amount during either of the two modes (e.g., during either the inversion or non-inversion period). This digital filter typically only needs to correct some of the least significant bits ("LSB's") of the pixel values during either operational mode. This is because the dynamic range of the flicker is often very limited (e.g., it is often less than 5%). In fact, some embodiments combine the flicker-filtering function with the dither-control function, if the correction of a LSB causes an over correction of the flicker problem.

BRIEF DESCRIPTION OF THE DRAWINGS

The novel features of the invention are set forth in the appended claims. However, for purpose of explanation, several embodiments of the invention are set forth in the following figures.

DETAILED DESCRIPTION OF THE INVENTION

The invention is directed towards method and apparatus for avoiding image flicker in an optical projection display. In the following description, numerous details are set forth for purpose of explanation. However, one of ordinary skill in the art will realize that the invention may be practiced without the use of these specific details. In other instances, well-known structures and devices are shown in block diagram form in order not to obscure the description of the invention with unnecessary detail.

Figure 1:
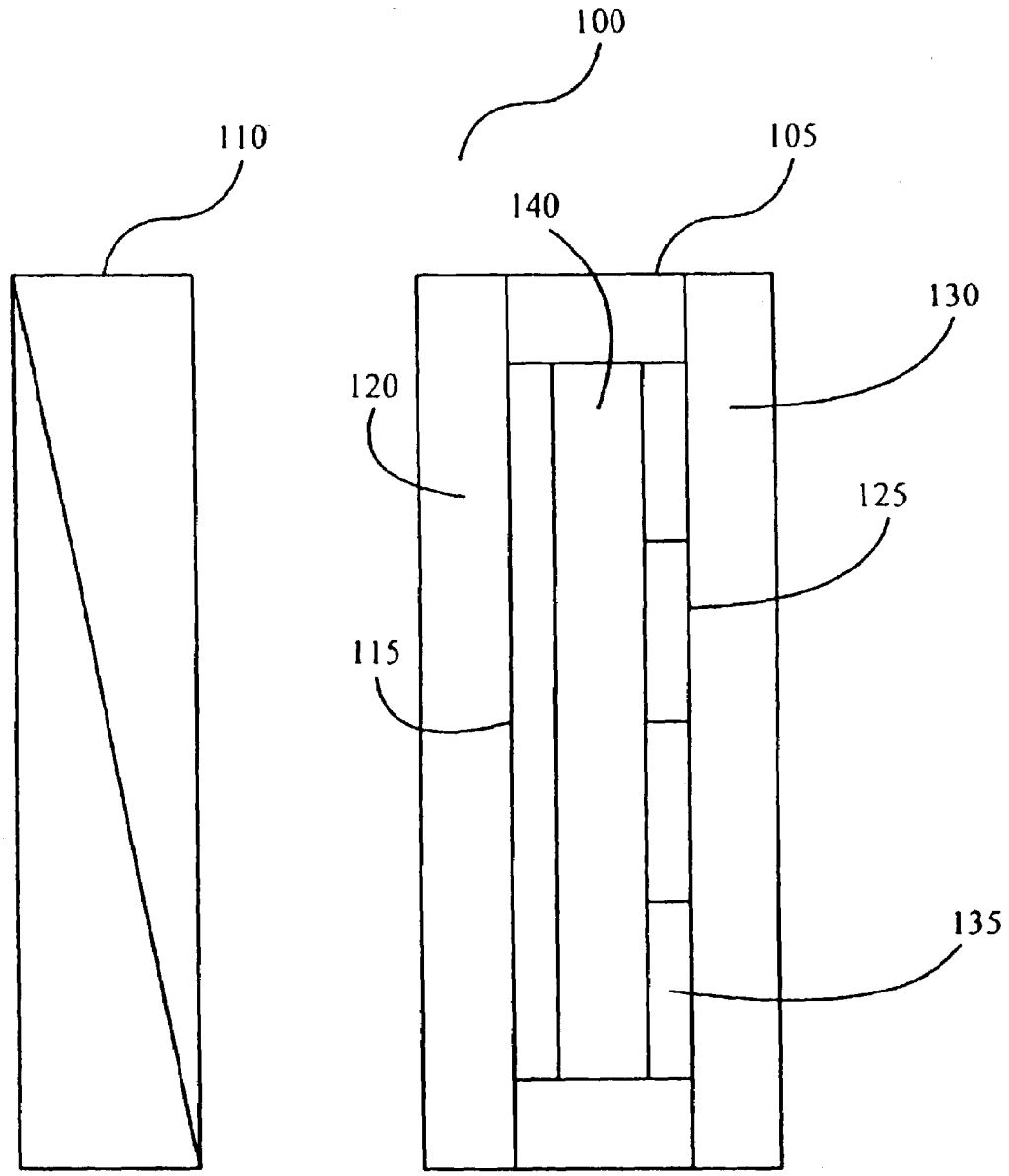
FIGURE 1 (PRIOR ART)
FIG. 1 presents a typical reflective light valve.
Figure 2:
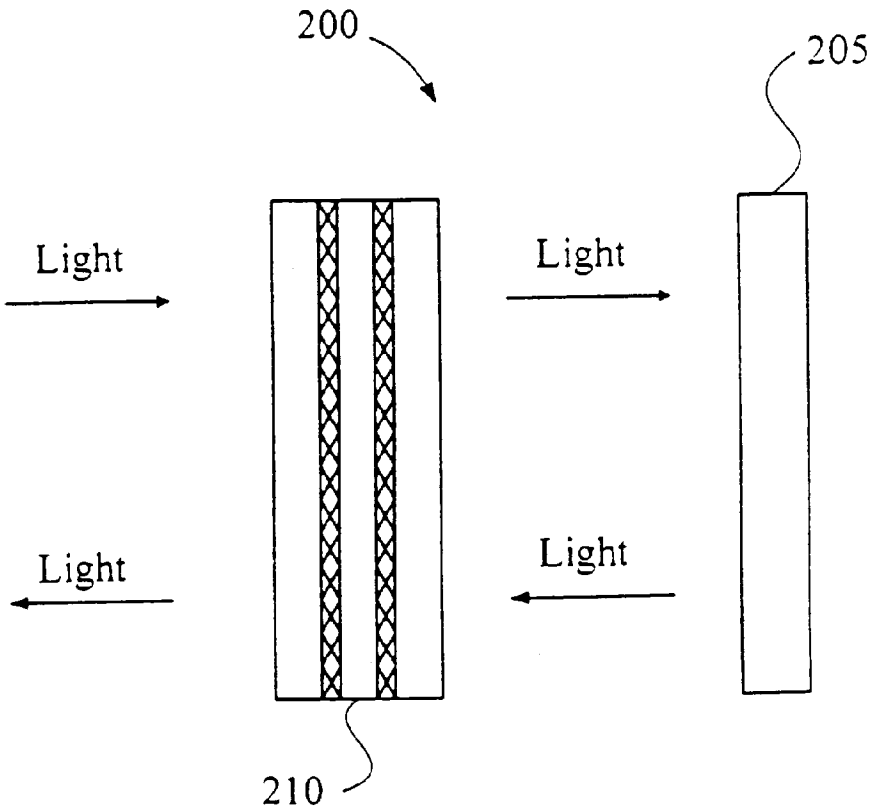
FIGURE 2 (PRIOR ART)
FIG. 2 presents an optical projection display that utilizes a polarization compensator.

One embodiment of the invention is a digital filter that avoids image flicker in a projection display. In a projection display, a viewer perceives image flicker when there is undesired light intensity variations between successive frames. For instance, as discussed above, a viewer of projection display 200 of FIG. 2 perceives image flicker due to the asymmetrical light throughput of the projection display during inversion and non-inversion periods. The asymmetrical light throughput of projection display 200 is due to the asymmetrical operation of one or more components of this display during the inversion and non-inversion periods.

The invention's digital filter avoids undesired intensity variations between successive frames by changing all the assigned pixel values by the same amount during either the inversion period or non-inversion period. This digital filter uniformly modifies all the assigned pixel values, because the asymmetric operation of the display's components uniformly affects the light coming from all the pixels. The invention's digital filter typically only needs to correct some of the least significant bits (LSB's) of the assigned pixel values during either the inversion period or non-inversion period. This is because the dynamic range of the flicker is often very limited (e.g., it is often less than 5%). In fact, if the change of a LSB causes an over correction, the invention's flicker filter can also modify the assigned pixel values to accomplish dithering.

Figure 3:
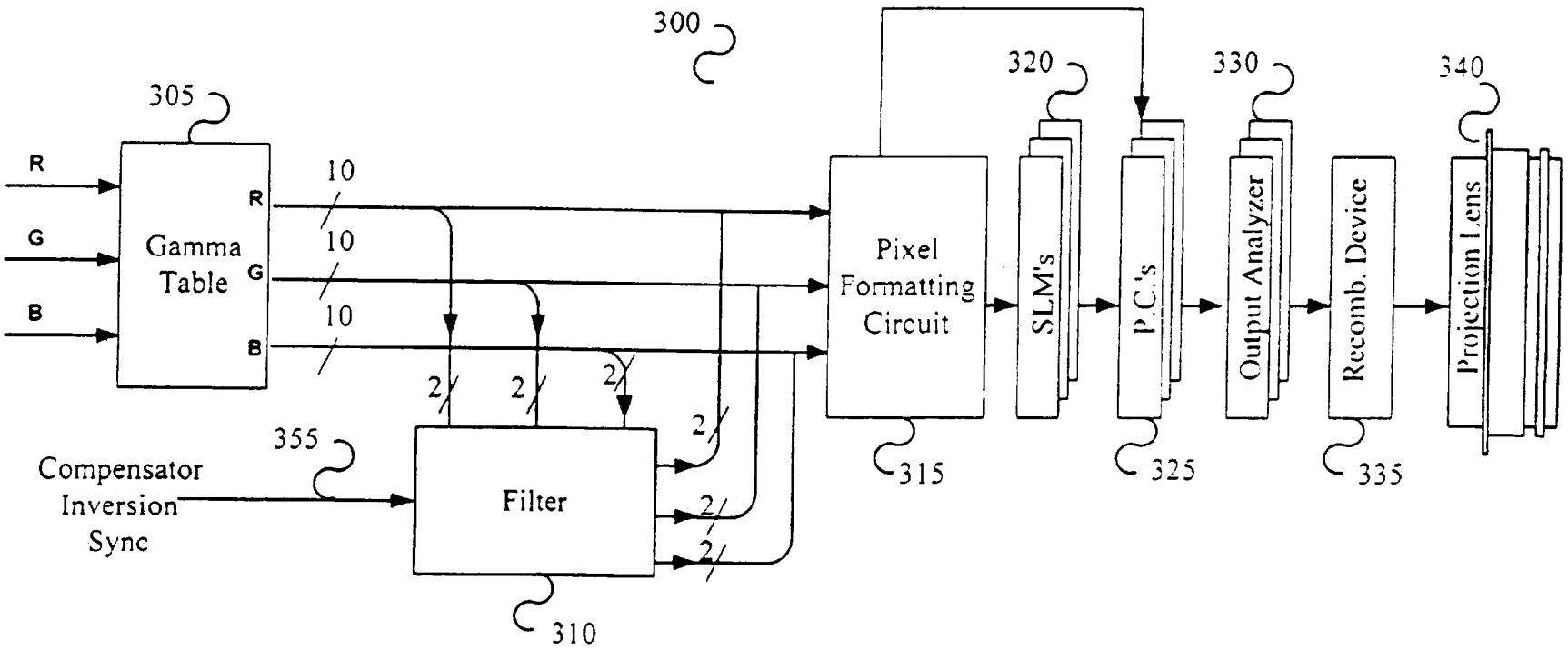
FIG. 3 presents an optical projection display that uses one embodiment of the invention.

FIG. 3 illustrates a projection display 300 that utilizes the invention's digital filter. This projection display includes a gamma look-up table ("LUT") 305, a digital filter 310, a pixel formatting circuit 315, three SLM's 320, three polarization compensators 325, three output analyzers 330, a recombination device 335, and a projection lens 340.

For each image frame, the gamma LUT 305 receives a set of assigned component-color values for each pixel in the image frame. For a 24-bit-per-pixel system, each component-color-value set for a pixel includes an 8-bit red value, an 8-bit green value, and an 8-bit blue value that respectively specify the quantity of red, green, and blue light that is assigned to the pixel in the image frame. The assigned pixel values specify how the pixel formatting electronics 325 should drive the individual SLM pixels to generate the desired image frames.

The gamma LUT 305 remaps the assigned pixel values within a given color space to provide a perceptually more linear gray scale response for the display output device of choice. The gamma LUT outputs gamma-corrected, 10-bit component-color values for each 8-bit component color value that it receives.

The flicker filter 310 then receives the two LSB's of each 10-bit component color value that the gamma LUT outputs. This filter avoids image flicker by changing all the assigned pixel values by the same amount during either the inversion period or non-inversion period. In the embodiment shown in FIG. 3, the flicker filter 310 modifies the LSB's during each inversion period, and therefore receives the inversion-period clock signal 355 to synchronize its operation with the inversion period.

In the embodiment presented in FIG. 3, the filter 310 does not change the least significant pixel value bits that it receives during the non-inversion period. It simply passes on these bits unchanged. One of ordinary skill in the art will understand, however, that other embodiments of the filter 310 perform their filtering operation by modifying the pixel values during the non-inversion period, and therefore synchronize their filtering operations with the non-inversion period.

As shown in FIG. 3, the digital filter 310 outputs two bits for each two LSB's that it receives. These output bits are supplied to pixel formatting circuit 315. This circuit combines each two LSB's output by the filter 310 with the eight unmodulated bits of their corresponding component-color value. The circuit 315 then formats the combined ten-bit pixel values to drive the three SLM's 320.

Projection display 300 uses three SLM's (one for each of the three component color values) since it is a simultaneous projection display that creates a color image by optically superimposing multiple partial-color images to the same location. In other embodiments, projection display 300 is a sequential projection display that uses one SLM to create an image by sequentially projecting red, green, and blue frames.

The circuit 315 drives the SLM's 320 in both an inversion mode and a non-inversion mode to avoid "stuck" pixels. The polarization compensators 325 receive the light that the SLM's output. The circuit 315 also drives this compensator in the inversion and non-inversion modes. In fact, the driving of the polarization compensators 325 and the SLM's 320 are synchronized so that the projection display presents the viewer with a positive image during both the inversion and non-inversion periods.

The output analyzers 330 receive the light output by the polarization compensators. The output analyzers are polarization-selective devices (such as polarizing filters or polarizing beam splitters) that allow a certain polarization state of the light to pass, while discarding the remaining polarization states. Hence, the output analyzers are placed at the output of the polarization compensators to obtain the modulation pattern of the SLM'S, and thereby generate images.

The recombination device 335 then combines the light from the three output analyzers and supplies this light to the projection lens 340, which projects the combined light onto a display screen (not shown). In alternative embodiments, the recombination device follows the polarization compensators and is before an output analyzer. In such embodiments, only one output analyzer is used.

Figure 4:
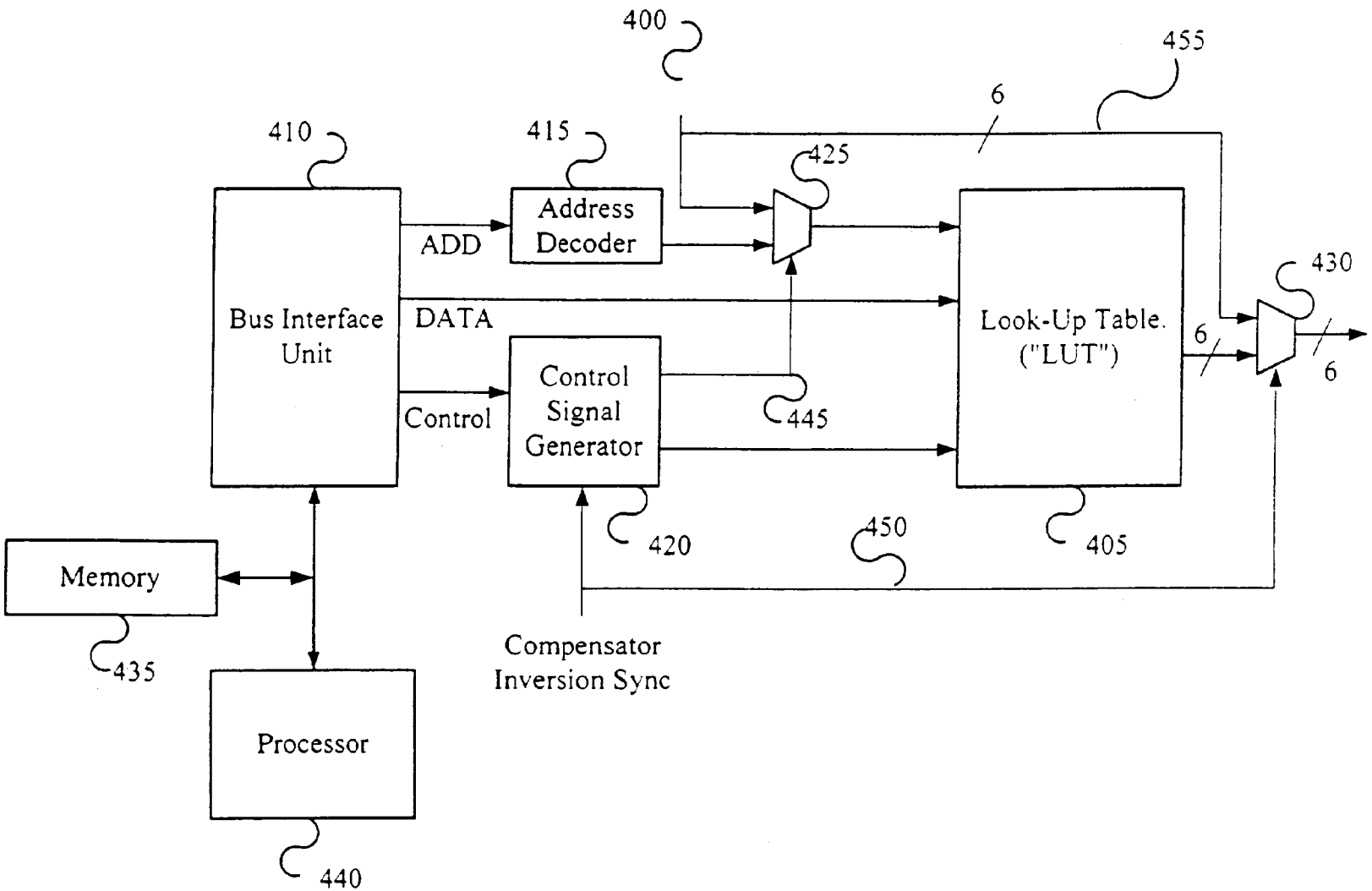
FIG. 4 presents a more detailed view of one embodiment of the invention.

FIG. 4 presents one embodiment of the flicker filter 310. In this embodiment, the flicker filter 310 is implemented as a combinational remapper 400 that avoids image flicker by remapping the LSB's of all assigned pixel values during the inversion period. The remapping operation changes all the assigned pixel values by a uniform programmed amount. As shown in FIG. 4, the filter 400 includes a LUT 405, a bus interface unit 410, an address decoder 415, a control signal generator 420, and two multiplexors 425 and 430. In some embodiments of the invention, the LUT 405 is a read-and-write memory (such as random access memory), while in other embodiments, it is a set of registers. The LUT 405 stores the remapped LSB pixel values that the filter 400 uses for remapping each set of six LSB's (i.e., two red LSB's, two green LSB's, and two blue LSB's) that the filter receives. Alternative embodiments use three LUT for the three color components (i.e., one for the red pixel values, one for the green pixel values, and one for the blue pixel values).

The LUT receives the remapped values from a memory 435 during a programming mode. A processor 440 initiates the programming mode by supplying a write signal to the bus interface unit 410. The bus interface unit serves as a buffer circuit that facilitates communication between the filter 400, the processor 440, and the memory 435. During the programming mode, the interface unit 410 also receives address and data signals from the processor 440 and/or a memory controller (not shown) of the memory 435.

The interface unit passes the received write signal to the control signal generator 420. This generator generates the appropriate control signals (e.g., RAS, CAS, and write control signals in embodiments where the LUT is a RAM) for placing the LUT in a write mode. The interface unit supplies the received address signals to the address decoder 415, which generates the address signals for identifying the appropriate addresses in the LUT to load. The generated address signals are supplied to the multiplexor 425. During the programming mode, the control signal generator 420 generates a control signal 445, which causes the multiplexor 425 to pass to the LUT the address signals generated by the address decoder. The loading of the remapped pixel values in the LUT commences when the LUT starts receiving (1) the address signals from the multiplexor 425, and (2) the data signals from the interface unit 410.

In some embodiments, the user initiates a programming mode when the user perceives a flicker. The processor then loads the LUT 405 with an initial set of remapped LSB's that differ from the assigned LSB's by an initial positive or negative amount. If the user continues to perceive the flicker after programming the LUT, the user can cause the processor to reload the LUT with a new set of remapped values that increase or decrease the difference between the remapped and assigned LSB's. If the change of a LSB causes an over correction, the processor can load the LUT with remapped LSB pixel values that not only avoid flicker but also accomplish dithering.

After the processor 440 programs the filter 400, it supplies a control signal to the control signal generator to set the filter in an operational mode. The operational mode includes two sub-modes: inversion and non-inversion modes. During an non-inversion mode, the control signal generator supplies a control signal 450 that causes multiplexor 430 to output the received LSB's 455 unchanged.

On the other hand, during the inversion periods, the control signal generator 420 generates control signals that cause multiplexor 425 to supply the received LSB's to the LUT. This unit 420 also generates control signals for reading the LUT at the address specified by the received LSB's. The LUT then outputs the remapped pixel data at the specified address, and the control signal generator 420 causes the multiplexor 430 to output the remapped pixel data output by the LUT.

One of skilled in the art will realize that the invention has numerous advantages. The invention provides an inexpensive solution for avoiding image flicker induced by the interaction between light valves and phase compensators in projection displays, such as LCOS microdisplays. The invention's approach can be easily manufactured and integrated in optical projection displays. It also takes into account process variations of the display's components over temperature and lifetime. The invention also allows a user to adjust the flicker correction by allowing the user to initiate and control the programming of the flicker filter.

Figure 5:
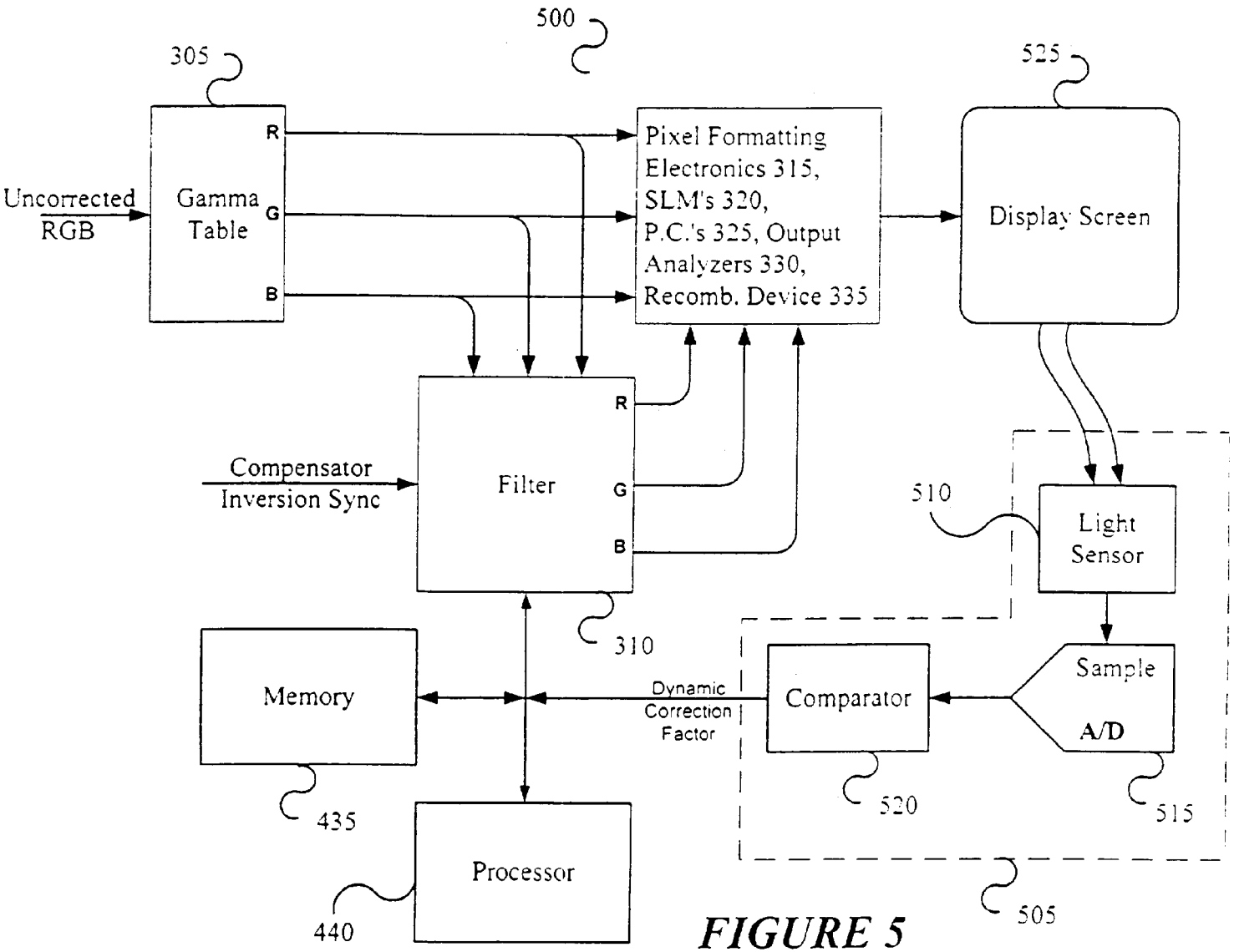
FIG. 5 presents another optical projection display that uses another embodiment of the invention.

The programming of the invention's flicker filter can also be automated. FIG. 5 presents a projection display 500 that can automatically program its flicker filter. This display is similar to projection display 300, with the exception that display 500 also includes an optical feedback path 505. The optical feedback path 505 (1) senses actual undesired intensity variation between frames generated during inversion and non-inversion periods, and (2) generates a dynamic correction factor that improves the filtering operation of the filter 310.

The optical feedback path 505 includes a light sensor 510, an analog-to-digital converter 515, and a comparator 520. The light sensor 510 senses the light intensity emanating from the display screen 525. It performs its sensing function either during the normal operation of the display or upon the invocation of a special test pattern. In some embodiments of the invention, this sensor includes a number of PIN diodes that focus on specific portion of the display screen that displays a test pattern during both inversion and non-inversion periods. The sensor 510 generates first and second sets of analog signals indicative of the light intensity values that it detects during inversion and non-inversion periods from the specific portion of the display screen.

The analog-to-digital converter 515 then converts these two sets of analog signals to two sets of digital signals. It then supplies these two sets of digital signals to the comparator 520. The comparator 520 then compares these two sets of digital signals, and generates a dynamic correction factor that indicates the degree of difference between the two sets of digital signals.

In some embodiments of the invention, this dynamic correction factor is supplied directly to the flicker filter 310, which modifies its operation to account for the detected light intensity differential. In other embodiments, this correction factor notifies the processor 440 of the undesired light-intensity differential between frames generated during inversion and non-inversion periods. Based on this correction factor, the processor 440 then loads the appropriate remapped pixel values from the memory 435 into the LUT 405 of the flicker filter.

In this manner, the projection display 500 can automatically program its flicker filter 310. The automated programming of the invention's flicker filter senses the light output from the actual optical path, and this permits the programming to perform display specific correction that takes into account aging and temperature effects on the optical system. While the invention has been described with reference to numerous specific details, one of ordinary skill in the art will recognize that the invention can be embodied in other specific forms without departing from the spirit of the invention. For instance, projection displays 300 and 500 have been illustrated to use a gamma-table before the invention's filter. Other projection displays that use the invention's flicker filter, however, position this filter before the gamma LUT or use a different gamma correction technique. Alternative embodiments might not even use gamma correction techniques.

Also, the invention's filter has been described above as avoiding flicker by uniformly modifying all the pixel values during either inversion or non-inversion period. Alternative embodiments, however, modify the assigned pixel values during both the inversion and non-inversion periods, in order to reduce or eliminate the uniform intensity differential during these two periods. Thus, one of ordinary skill in the art would understand that the invention is not to be limited by the foregoing illustrative details, but rather is to be defined by the appended claims.

I claim:

1. An optical projection display having a plurality of components, said components including:

(a) a spatial light modulator, (b) a pixel-formatting circuit for driving the spatial light modulator in a first operational mode and a second operational mode, wherein at least one component of the projection display operates non-ideally during at least one of the modes, and (c) a digital filter (i) receiving assigned pixel values for driving the spatial light modulator during said operational modes, and (ii) avoiding image flicker due to the non-ideal operation of said component by changing the assigned pixels values by a uniform amount during the first operational mode and not changing the assigned pixel values during the second operational mode.

2. The optical projection display of claim 1, wherein the spatial light modulator includes a number of pixels, and the pixel-formatting circuit drives said pixels with the changed pixel values during the first operational mode.

3. The optical projection display of claim 2 further comprising an optical feedback circuit for sensing light intensity variations between images produced by the display during the first operational mode and second operational mode, and generating a correction factor indicative of the sensed light intensity variation, said digital filter receiving the correction factor and modifying the uniform amount that it uses to change the assigned pixel values during the first operational mode.

4. The optical projection display of claim 1, wherein said digital filter is operable to remaps a set of least significant bits of each assigned pixel value during said first operational mode.

5. The optical projection display of claim 4, further comprising a memory operable with said digital filter so that as said digital filter remaps said set of least significant bits of each assigned pixel value said digital filter uses each set of least significant bits to retrieve a new set of least significant bits from said memory.

6. A method of avoiding flicker in images produced by an optical projection display that includes a spatial light modulator, the spatial light modulator driven in a first operational mode and a second operational mode, the method comprising:

receiving assigned pixel values during the first and second operational modes, said pixel values for driving the spatial light modulator during the first and second operational modes, and changing the assigned pixels values by a uniform amount during the first operational mode and leaving unchanged the assigned pixel values during the second operational mode.

7. The method of claim 6, wherein the spatial light modulator includes a number of pixels, the method further comprising driving the pixels of the spatial light modulator with the changed pixel values during the first operational mode.

8. An optical projection display that has a plurality of components including a spatial light modulator, the spatial light modulator driven in an inversion mode and a non-inversion mode, wherein at least one component of the projection display operates non-ideally during at least one of the modes, a method for avoiding image flicker caused by the non-ideal operation of said component, said method comprising:

receiving assigned pixel values during the inversion and non-inversion modes, said pixel values for generating signals to drive the spatial light modulator during the inversion and non-inversion modes, and changing the assigned pixels values by a uniform amount during the one of the inversion and non-inversion modes and leaving unchanged the assigned pixel values during the other one of the inversion and non-inversion modes.

9. The method of claim 8, wherein the spatial light modulator includes a number of pixels, the method further comprising:

generating signals from the changed pixel values, and driving the pixels of the spatial light modulator with the generated signals.

10. The method of claim 8 further comprising:

sensing the light intensity of the images produced by the display during both the inversion and non-inversion modes, generating a correction factor indicative of a uniform intensity variation between images produced during the inversion mode and images produced during the non-inversion mode, and using the correction factor to calculate the uniform amount for changing the assigned pixels values during the one of the inversion and non-inversion modes.

11. An optical projection display having a plurality of components including a spatial light modulator with pixels, the projection display comprising:

a pixel-formatting circuit operable to drive the spatial light modulator in a first operational mode and a second operational mode, wherein at least one component of said projection display operates non-ideally during at least one of said first operational mode and said second operational mode; and a digital filter (i) operable to receive assigned pixel values to drive the spatial light modulator during said first operational mode and said second operational mode, and (ii) operable to avoid image flicker due to non-ideal operation of said at least one component by modifying the assigned pixels values by a uniform amount only during said first operational mode.

12. The optical projection display of claim 11, wherein said pixel-formatting circuit drives the pixels of the spatial light modulator with the changed pixel values during said first operational mode.

13. The optical projection display of claim 12, further comprising an optical feedback circuit operable to sense light intensity variations between images produced by the display during said first operational mode and said second operational mode, and operable to generate a correction factor indicative of the sensed light intensity variation.

14. The optical projection display of claim 13, wherein said digital filter is operable to receive said correction factor and modify said assigned pixel values with said correction factor by said uniform amount during said first operational mode.

* * * * *